US005197620A

United States Patent [19]

Gregory

[11] Patent Number: 5,197,620

[45] Date of Patent: Mar. 30, 1993

[54] VENTING CLOSURE

[75] Inventor: James L. Gregory, Toledo, Ohio

[73] Assignee: Owens-Illinois Closure Inc., Toledo, Ohio

[21] Appl. No.: 874,488

[22] Filed: Apr. 27, 1992

[51] Int. Cl.[5] ..... B65D 51/16

[52] U.S. Cl. ..... 215/307; 220/366

[58] Field of Search ..... 215/307, 330, 331, 252; 220/289, 303, 366

[56] References Cited

U.S. PATENT DOCUMENTS

| | | | |
|---|---|---|---|
| 1,528,566 | 3/1925 | Podel . | |
| 1,548,459 | 8/1925 | Hammer . | |
| 3,118,578 | 1/1964 | Collins . | |
| 4,007,848 | 2/1976 | Snyder | 215/307 X |
| 4,093,096 | 6/1978 | Augros . | |
| 4,289,248 | 9/1981 | Lynn . | |
| 4,387,822 | 6/1983 | Lynn . | |
| 4,427,126 | 1/1984 | Ostrowsky | 215/307 |
| 4,674,643 | 6/1987 | Wilde et al. . | |
| 4,717,034 | 1/1988 | Mumford | 215/318 |
| 4,736,859 | 4/1988 | Mayes et al. . | |
| 4,738,370 | 4/1988 | Urmston et al. | 215/307 |
| 4,747,502 | 5/1988 | Luenser | 215/307 |
| 4,770,308 | 9/1988 | Lynn . | |
| 4,997,097 | 3/1991 | Krautkrämer | 215/307 |
| 5,090,788 | 2/1992 | Ingram et al. | 215/252 |

*Primary Examiner*—Allan N. Shoap
*Assistant Examiner*—Stephen Cronin

[57] ABSTRACT

A plastic venting closure comprising a base wall, a peripheral skirt having internal threads adapted to engage the threads of a container and wherein the threads are interrupted at circumferentially spaced points to define axial venting passages for dissipating pressure of the contents as the closure is unthreaded from a container. At least some of the passages have an integral rib thereon spaced from the threads and extending axially. The radial thickness of each rib is less than that of the threads and preferably is arcuate in a radial direction and arcuate in a axial direction and preferably has an axial length greater than a transverse width such that it may span and engage several threads at the same time. The closure can be used with a glass container having a continuous thread and a plastic container having continuous thread or an interrupted thread. By having each rib arcuate in an axial direction it may engage a plurality of threads at different radial points on the rib thereby minimizing application and removal torque while centering the container relative to the closure.

8 Claims, 3 Drawing Sheets

VENTING CLOSURE

This invention relates to plastic venting closures.

BACKGROUND AND SUMMARY OF THE INVENTION

In closures adapted to be used for packaging pressurized contents such as carbonated beverages, it is common to utilize a closure that has a base wall, a peripheral skirt within internal threads wherein the threads are interrupted to form venting passages so that when the closure is unthreaded from a container, the pressure of the contents is dissipated through the venting passages. When the closure is made of plastic, the tolerances in manufacture may result in the closure tending to move radially relative to the container so that at least some of the venting passages may be obstructed thereby adversely affecting the venting of the contents.

Among the objectives of the present invention are to provide a plastic closure wherein the closure permits an improved radial positioning with respect to the container; wherein the construction for providing such an action is obtained at minimal expense; and wherein the construction does not adversely affect the application of the closure to a container by automatic machinery; and wherein the closure can be used with glass or plastic containers.

In accordance with the invention, a plastic venting closure comprising a base wall, a peripheral skirt having internal threads adapted to engage the threads of a container and wherein the threads are interrupted at circumferentially spaced points to define axial venting passages for dissipating pressure of the contents as the closure is unthreaded from a container. At least some of the passages have an integral rib thereon spaced from the threads and extending axially. The radial thickness of each rib is less than that of the threads and preferably is arcuate in a radial direction and arcuate in a axial direction and preferably has an axial length greater than a transverse width such that it may span and engage swivel threads at the same time. The closure can be used with a glass container having a continuous thread and a plastic container having a continuous thread or an interrupted thread. By having each rib arcuate in an axial direction it may engage a plurality of threads at different radial points on the rib thereby minimizing application and removal torque while centering the container relative to the closure.

DESCRIPTION

Figure 6:
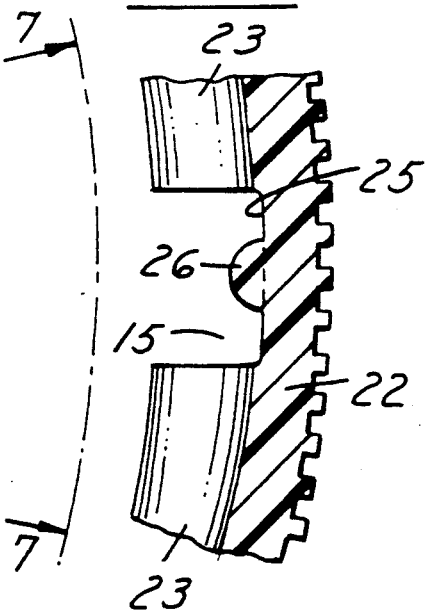
FIG. 6 is is a fragmentary sectional view taken along the line 6—6 in FIG. 5.
Figure 7:
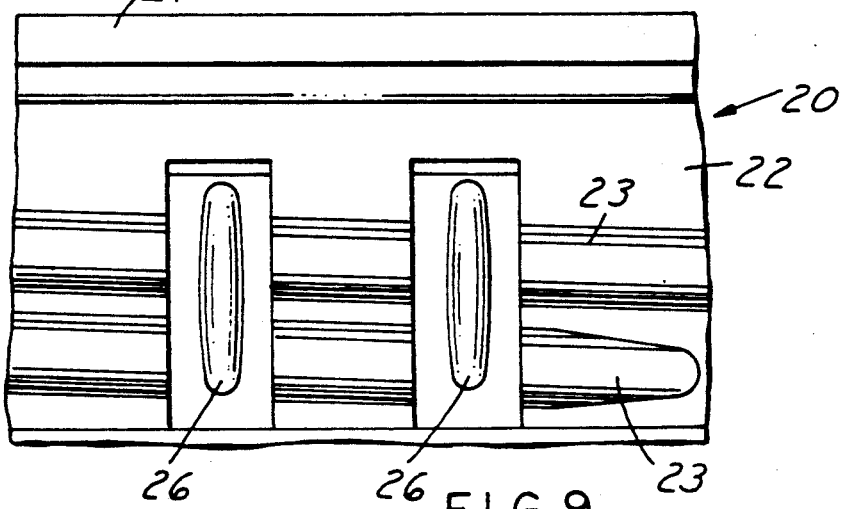
FIG. 7 is a fragmentary view taken along the line 7—7 in FIG. 6.

Referring to FIGS. 1–6, the plastic venting closure 20 embodying the invention comprises a base wall 21, a peripheral skirt 22 having internal threads 23 adapted to engage the helical threads 24 of a container C. The threads 23 are interrupted at circumferentially spaced points to define axial venting passages 25 for dissipating pressure of the contents as the closure is unthreaded from a container. At least some of the passages 25 have an integral rib 26 thereon spaced from the threads and extending axially. The radial thickness of each rib 26 is less than that of the threads 23 and preferably is arcuate in a radial direction (FIG. 5) and arcuate in an axial direction (FIG. 6). The ribs 26 are preferably equally spaced and a rib 26 is preferably provided in each passage. The circumferential width of each rib 26 is substantially less than the width of the respective venting passage 25.

Figure 3:
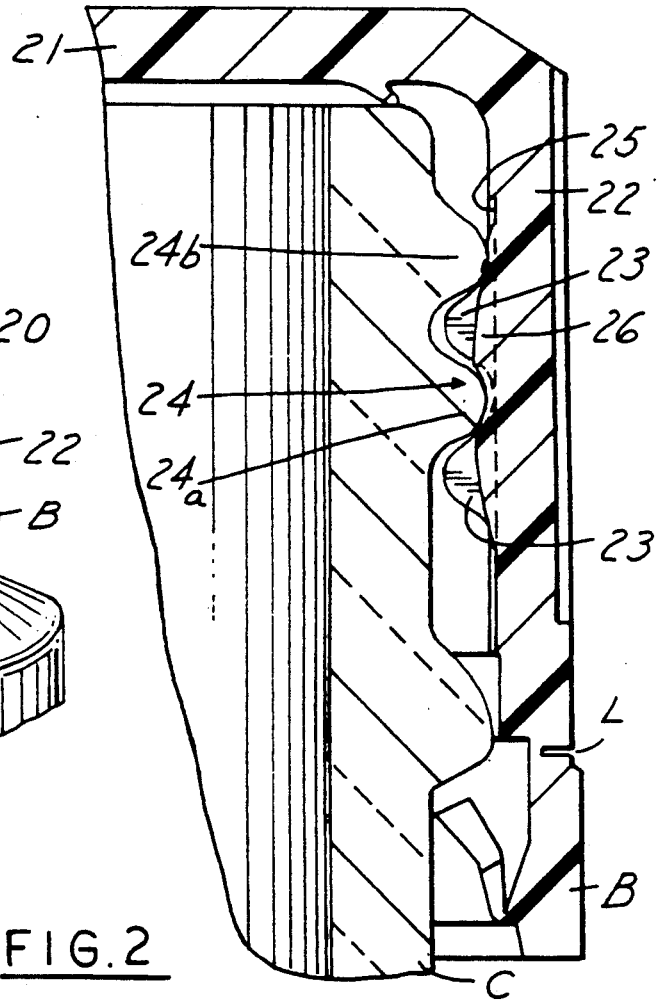
FIG. 3 is a fragmentary sectional view on a further enlarged scale.
Figure 1:
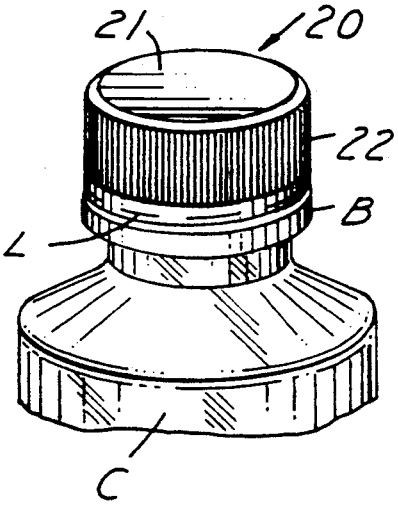
FIG. 1 is a fragmentary perspective view of a container and closure embodying the invention.
Figure 2:
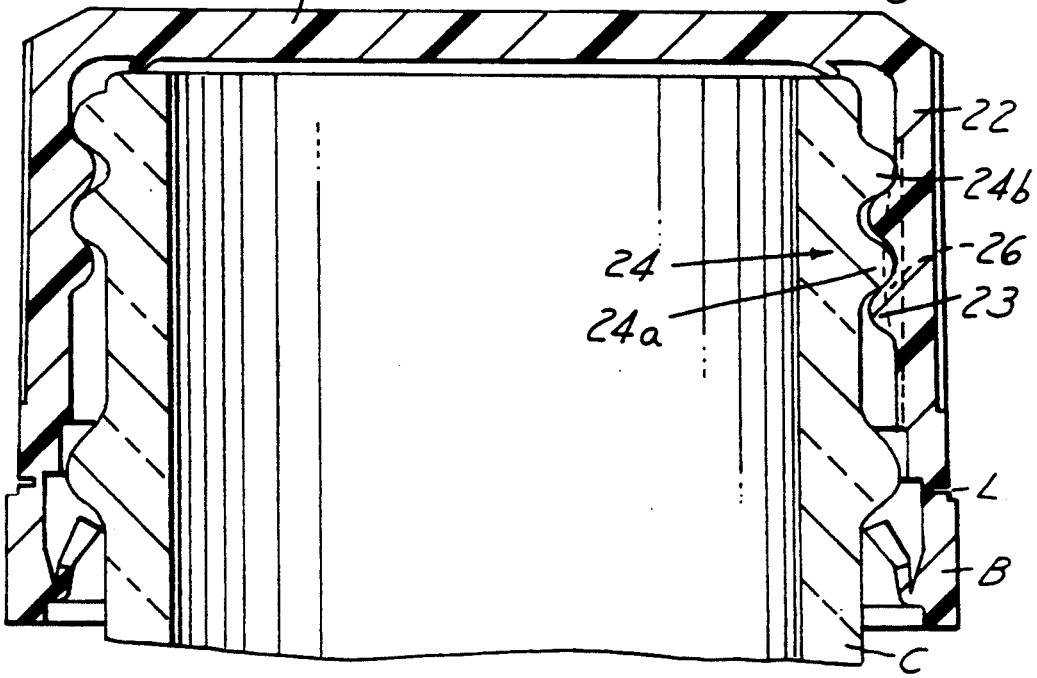
FIG. 2 is a fragmentary sectional view of the container and closure on an enlarges scale.
Figure 4:
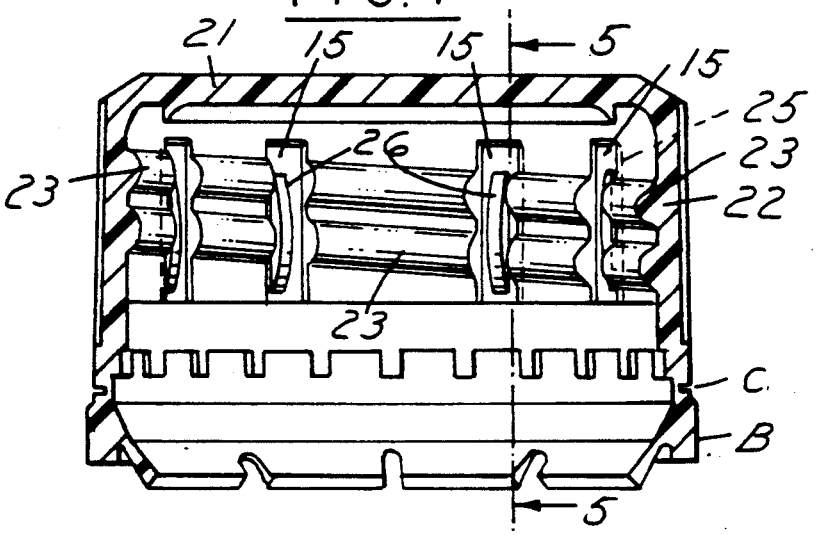
FIG. 4 is a sectional view of the closure.
Figure 5:
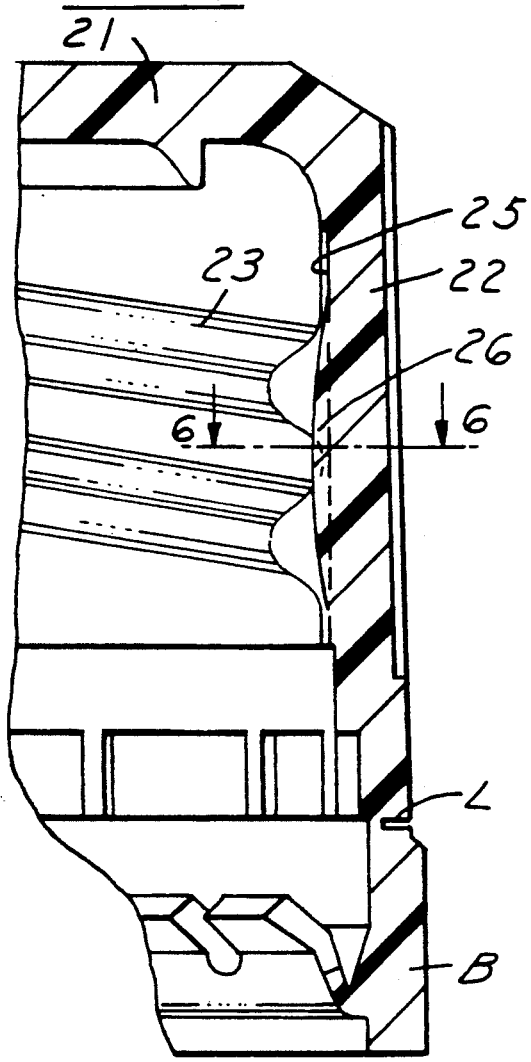
FIG. 5 is a fragmentary sectional view on an enlarged scale taken along the line 5—5 in FIG. 4.

The cross section of each rib 26 is preferably arcuate in vertical cross section to facilitate application by automatic machinery and is preferably arcuate in horizontal or radial cross section in order to minimize the force caused by engagement of the threads 24 therewith during application. Preferably each rib 26 has an axial length greater than a transverse width such that it may span and engage swivel threads at the same time. The closure can be used with a glass container having a continuous thread and a plastic container having continuous thread or an interrupted thread. By having each rib 26 arcuate in an axial direction it may engage a plurality of threads at different radial points on the ribs thereby minimizing application and removal torque while centering the container relative to the closure. In this manner at least two threads may be engaged by a rib 26, with one thread 23 deforming the rib 26 more than an axially adjacent thread 24. As shown in FIG. 3, for example, container thread **24*a* engages rib 26 at its radially thickest point, while thread 24*b* engages rib 26** at its radially thinner point.

The closure 20 may be made of any conventional plastic such as polypropylene or polyethylene. The closure 20 also preferably includes a tamper indicating band B connected to the skirt 12 along a weakened line L, such as shown in U.S. application Ser. No. 07/386,391 filed July 27, 1989, now U.S. Pat. No. 5,090,788, incorporated herein by reference.

Figure 8:
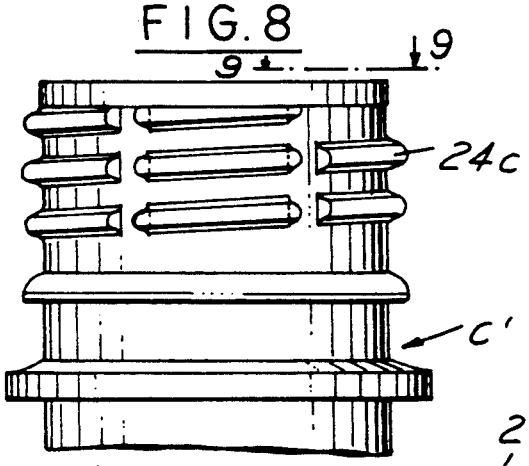
FIG. 8 is a fragmentary elevational view of a portion of a plastic container that can be used with the closure.
Figure 9:
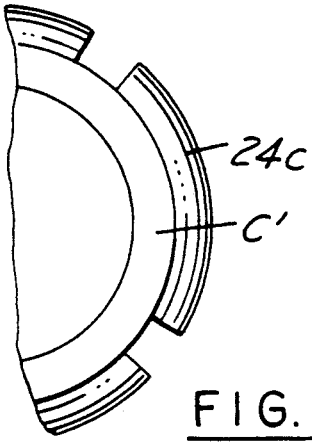
FIG. 9 is a fragmentary plan view taken along the line 9—9 in FIG. 8.
Figure 10:
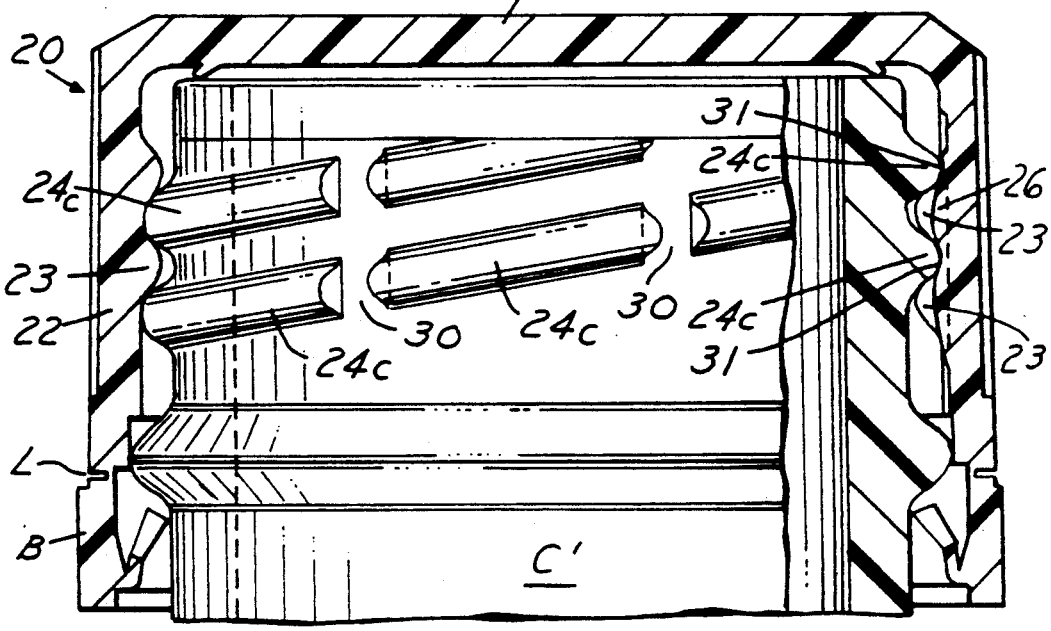
FIG. 10 is a fragmentary sectional view showing the closure applied to the container shown in FIGS. 8 and 9.

In the form shown in FIGS. 8–10, the closure 20 is utilized with a plastic container made of material such as PET that has continuous threads or, as shown, has interrupted threads **24*c* defining axial venting passages 30** on the neck of the container C'.

In this form, the threads **24*c* not only deform the ribs 26 but also the edges 31 of the thread segments tend to cut into the ribs 26**.

In each of the forms, the ribs also limit the extent that the skirt of the closure can be squeezed by a user during removal of the closure. In this manner, the skirt is prevented from being squeezed sufficiently to restrict the venting passages.

It can thus be seen that there has been provided a closure wherein the closure permits an improved radial positioning with respect to the container; wherein the construction for providing such an action is obtained at minimal expense; and wherein the construction does not adversely affect the application of the closure to a container by automatic machinery; and wherein the closure can be used with glass or plastic containers.

I claim:

1. A plastic venting closure comprising a base wall, a peripheral skirt having internal threads adapted to engage the threads of a container and wherein the threads are interrupted at circumferentially spaced points to define axial venting passages for dissipating pressure of the contents as the closure is unthreaded from a container, at least some of the passages have an integral rib thereon spaced from the threads and extending axially, and the radial thickness of each rib being less than that of the threads, the circumferential width of each rib being less than the circumferential width of the respective venting passage.

2. The closure set forth in claim 1 wherein each said rib is arcuate in radial cross section.

3. The closure set forth in claim 1 wherein each said rib is arcuate in vertical cross section.

4. The closure set forth in claim 1 wherein each said rib is arcuate in vertical section and has a length such that the rib spans at least a portion of two threads.

5. The closure set forth in claim 1 wherein said ribs are substantially equally spaced.

6. The closure set forth in claim 1 wherein a rib is provided in each said venting passage.

7. The closure set forth in any one of claims 1–6 in combination with a glass container having threads thereon, said ribs being deformed by said threads.

8. The closure set forth in any one of claims 1–6 including a container having threads, said threads being interrupted to form axial venting passages on the container, said interrupted threads deforming said ribs.

* * * * *